US010283305B2

(12) United States Patent
Kondo et al.

(10) Patent No.: US 10,283,305 B2
(45) Date of Patent: May 7, 2019

(54) FUSE

(71) Applicant: Pacific Engineering Corporation, Ogaki-shi (JP)

(72) Inventors: Daiji Kondo, Ogaki (JP); Masahiro Kimura, Ogaki (JP)

(73) Assignee: Pacific Engineering Corporation, Ogaki-Shi (JP)

( * ) Notice: Subject to any disclaimer, the term of this patent is extended or adjusted under 35 U.S.C. 154(b) by 31 days.

(21) Appl. No.: 14/903,017

(22) PCT Filed: Jun. 10, 2014

(86) PCT No.: PCT/JP2014/003102

§ 371 (c)(1),
(2) Date: Jan. 5, 2016

(87) PCT Pub. No.: WO2015/004844

PCT Pub. Date: Jan. 15, 2015

(65) Prior Publication Data

US 2016/0141139 A1 May 19, 2016

(30) Foreign Application Priority Data

Jul. 12, 2013 (JP) ..... 2013-146299

(51) Int. Cl.
*H01H 85/175* (2006.01)
*H01H 85/045* (2006.01)
(Continued)

(52) U.S. Cl.
CPC ..... *H01H 85/0456* (2013.01); *H01H 85/045* (2013.01); *H01H 85/0417* (2013.01); *H01H 85/153* (2013.01); *H01H 85/175* (2013.01)

(58) Field of Classification Search
CPC ..... H01H 85/045; H01H 85/0452; H01H 85/0456; H01H 85/153; H01H 85/165; H01H 85/175
(Continued)

(56) References Cited

U.S. PATENT DOCUMENTS 4,420,214 A * 12/1983 Wu ..... H01R 13/68 337/198
4,499,447 A 2/1985 Greenberg
(Continued)

FOREIGN PATENT DOCUMENTS

EP 0259926 A1 3/1988
EP 1093146 A2 4/2001
(Continued)

OTHER PUBLICATIONS

Original and English translation of International Search Report for PCT/JP2014/003102 dated Aug. 5, 2014 (4 pages).
(Continued)

*Primary Examiner* — Jacob R Crum
(74) *Attorney, Agent, or Firm* — Shumaker, Loop & Kendrick, LLP

(57) ABSTRACT

The invention provides a fuse that has a simple structure without having a flap included in a conventional fuse but can prevent a terminal of a different fuse from entering from an opening of an insulating housing. A fuse includes a pair of conductive terminals (10), a fuse element (30) including a fusing part (20) provided between the conductive terminals (10), and an insulating housing (40) covering the fusing part (20) and at least part of the conductive terminals (10) and having an open bottom end. The insulating housing (40) has an open end (50) provided, on an inner wall surface thereof, with a projection (60).

8 Claims, 13 Drawing Sheets

(51) Int. Cl.
*H01H 85/153* (2006.01)
*H01H 85/041* (2006.01)

(58) Field of Classification Search
USPC ..... 337/187, 198, 255, 414
See application file for complete search history.

(56) References Cited

U.S. PATENT DOCUMENTS 5,629,664 A * 5/1997 Muramatsu ..... H01H 85/0417 337/190
5,841,338 A * 11/1998 Yasukuni ..... H01H 85/0411 337/164
6,452,474 B1 * 9/2002 Oh ..... H01H 85/0417 337/186
6,459,356 B1 10/2002 Dout
6,556,121 B2 * 4/2003 Endo ..... H01H 85/0417 337/142
6,815,841 B1 * 11/2004 Brown ..... H01H 85/046 307/10.1
2001/0026210 A1 10/2001 Endo et al.
2005/0212647 A1 * 9/2005 Goldsberry ..... H01H 85/0417 337/198

FOREIGN PATENT DOCUMENTS

EP 1139372 A2 10/2001
JP 61-176026 A 8/1986
JP 2001-283708 A 10/2001
JP 2002-133998 A 5/2002

OTHER PUBLICATIONS

European Search Report for EP App. No. 14822372.0 dated Jan. 17, 2017 (8 pages).

* cited by examiner

FUSE

TECHNICAL FIELD

The present invention relates to a fuse provided mainly at an electric circuit of a motor vehicle.

BACKGROUND ART

A fuse has been conventionally used to protect an electric circuit mounted to a motor vehicle or the like and various electric components connected to the electric circuit. Specifically, when unintended excess current flows in the electric circuit, a fusing part of the fuse fuses due to heat generated by excess current and protects so as not to allow excess current to flow to the various electric components.

There are known many types of fuses, such as a fuse 500 depicted in FIGS. 7(*a*) and 7(*b*) of Patent Literature 1.

As depicted in FIGS. 7(*a*) and 7(*b*), the fuse 500 according to Patent Literature 1 includes a fuse element 530 having a plate shape and provided with a fusing part 520, and an insulating housing 540 covering the fuse element 530. The fuse 500 is produced by attaching the fuse element 530 to the insulating housing 540 such that the fuse element 530 is inserted from an open end 550 provided at the bottom of the insulating housing 540.

In a case where, for example, a plurality of fuses 500 is packed and the bottom of the insulating housing 540 of each of the fuses 500 remains open, a terminal of a different one of the fuses may enter the insulating housing 540 from the open end 550 and damage the fusing part 520.

As depicted in FIG. 7(*b*), the fuse 500 is provided with a flap 560 closing the open end 550 at the bottom so as to protect the fusing part 520. This flap 560 is provided by bending part of the insulating housing 540 so as to close the open end 550. As depicted in FIG. 7(*a*), a locking claw 531 is provided inside each terminal 510 in order to prevent the bent flap 560 from returning to an unbent state.

The fuse 500 according to Patent Literature 1, however, additionally requires the step of bending the flap to provide the flap 560 as well as a measure to prevent the bent flap from returning to the unbent state.

CITATIONS LIST

Patent Literature

Patent Literature 1: JP 2012-017753

SUMMARY

In view of the above, it is an object of the present invention to provide a fuse that has a simple structure without having a flap included in a conventional fuse but can prevent a terminal of a different fuse from entering from an opening of an insulating housing.

A fuse according to the present invention includes: a pair of conductive terminals; a fuse element including a fusing part provided between the conductive terminals; and an insulating housing covering the fusing part and at least part of the conductive terminals and having an open bottom end; wherein the insulating housing has an open end provided, on an inner wall surface thereof, with a projection.

According to the characteristic described above, the insulating housing is provided with the projection on the inner wall surface of the open end. Even when a plurality of fuses is packed and a terminal of a different fuse tends to enter the insulating housing, the terminal of the different fuse comes into contact with the projection and cannot proceed further inward. The fusing part accommodated in the insulating housing will not be damaged by the terminal of the different fuse. Such a simple structure provided with the projection on the inner wall surface of the open end of the insulating housing can prevent the terminal of the different fuse from entering from the opening of the insulating housing.

Furthermore, the projection thus provided requires no provision of any flap as in a conventional fuse, no step of bending the flap, or no measure to prevent the bent flap from returning to an unbent state.

In the fuse according to the present invention, the projection is provided from an open surface to an upper end of the inner wall surface of the insulating housing.

The fusing part melts to be cut off due to heat generated by excess current flowing to the fuse. In a case where the fusing part is small in volume as in a low rated fuse, the fusing part may soften before fusing and hang downward due to gravity.

When the fusing part thus melted and hanging downward comes into contact with the inner wall of the insulating housing, heat transfers to the insulating housing through a contact portion therebetween. The fusing part having lost heat is unlikely to reach its melting point and cannot fuse within a predetermined time period. As a result, prescribed fusing properties cannot be exerted and various electric components may not be protected by prevention of a flow of excess current.

According to the characteristic of the present invention, however, the projection is provided from the open surface to the upper end of the inner wall surface of the insulating housing. Even when the fusing part accommodated in the insulating housing hangs downward, it comes into contact with the projection. The fusing part can have less contact area by contacting with the projection than by contacting with the flat inner wall surface of the insulating housing. This configuration suppresses quantity of heat transferring through the contact portion of the hanging fusing part. The fusing part is thus likely to reach the melting point and can fuse within a prescribed fusing time period.

In the fuse according to the present invention, the projection is provided on the inner wall surface at each side in a thickness direction of the insulating housing.

According to the characteristic described above, the projection is provided on the inner wall surface at each of the ends in the thickness direction of the insulating housing. This configuration can reliably prevent the terminal of the different fuse from entering obliquely or vertically from the opening of the insulating housing.

As described above, the fuse according to the present invention has a simple structure without having a flap included in a conventional fuse but can prevent a terminal of a different fuse from entering from the opening of the insulating housing.

3(*c*) is a sectional view taken along line B-B indicated in FIG. 3(*b*), and FIG. 3(*d*) is a bottom view of a state where a fusing part hangs downward.

FIGS. 4(*a*) to 4(*d*) are explanatory bottom views of preventing a terminal of a different fuse from entering the insulating housing of the fuse according to the present invention.

Figure 5A:
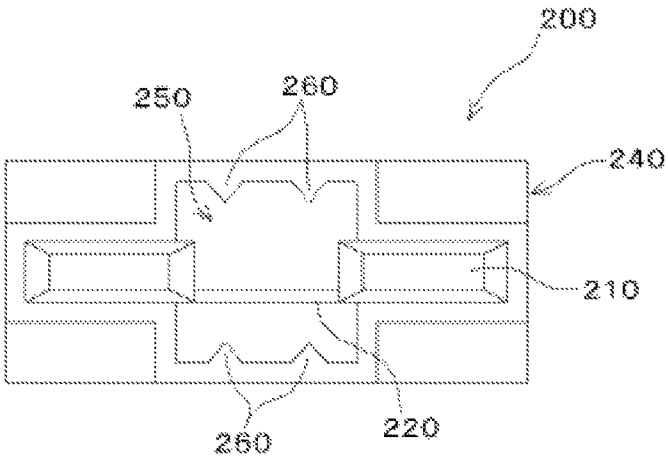
Figure 5B:
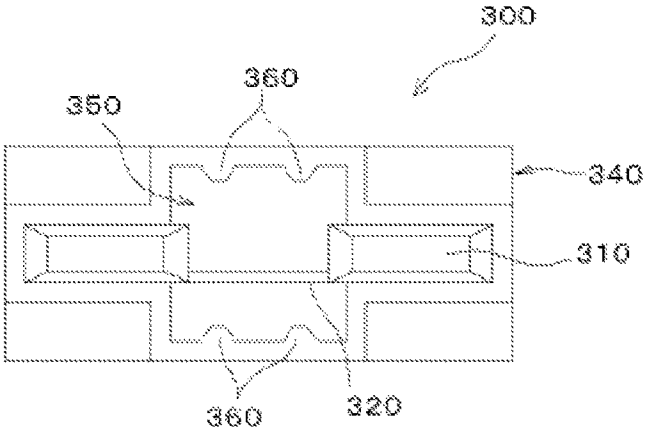
Figure 6B:
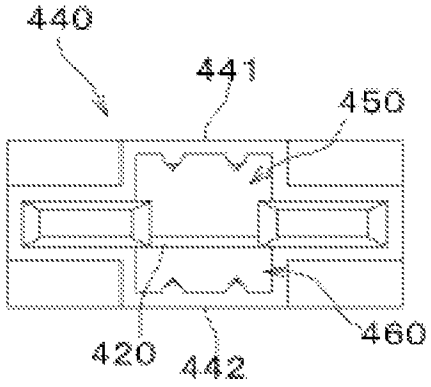
Figure 6A:
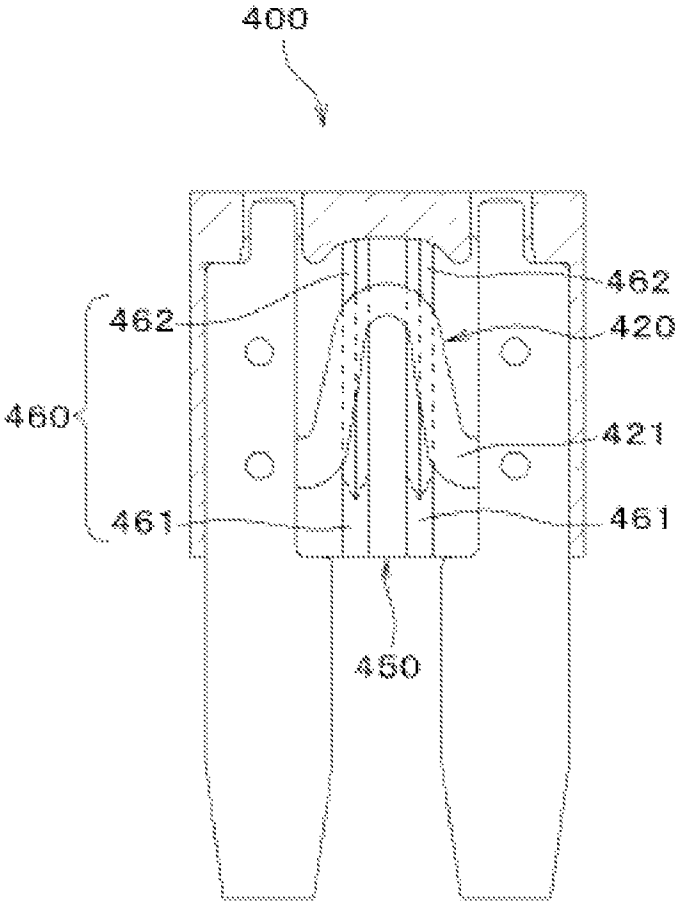
Figure 6D:
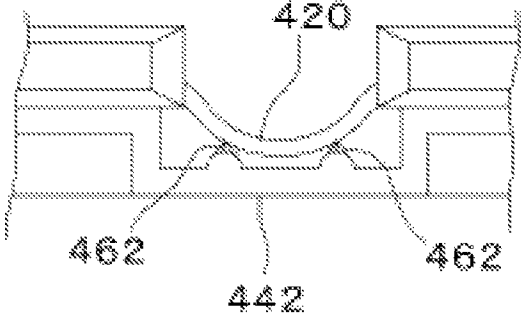
Figure 6C:
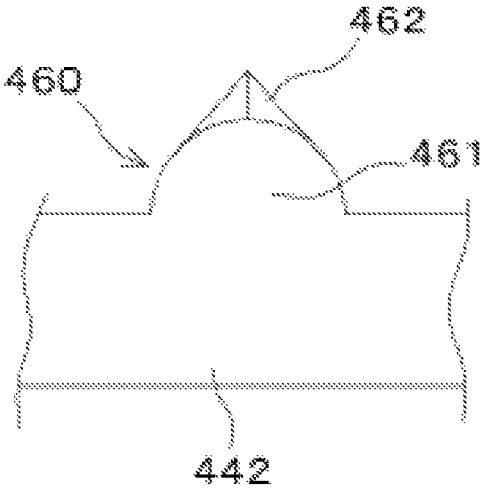

FIG. 5(*a*) is a bottom view of a fuse according to a modification example 1 of the present invention, and FIG. 5(*b*) is a bottom view of a fuse according to a modification example 2 of the present invention.

FIG. 6(*a*) is a sectional view of a fuse according to a modification example 3 of the present invention, FIG. 6(*b*) is a bottom view thereof, FIG. 6(*c*) is an enlarged bottom view of a projection and its vicinity, and FIG. 6(*d*) is a bottom view of a state where a fusing part melts and hangs downward.

Figure 7B:
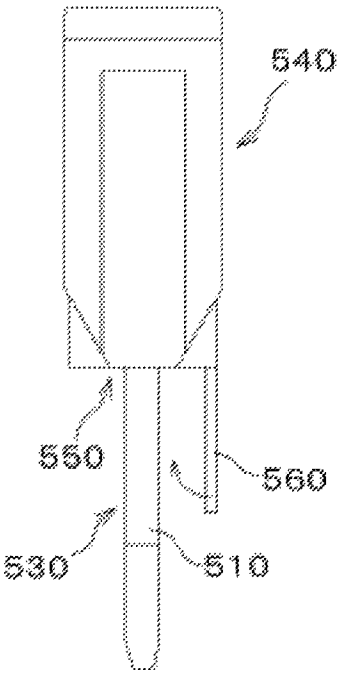
Prior Art FIG. 7B
Figure 7A:
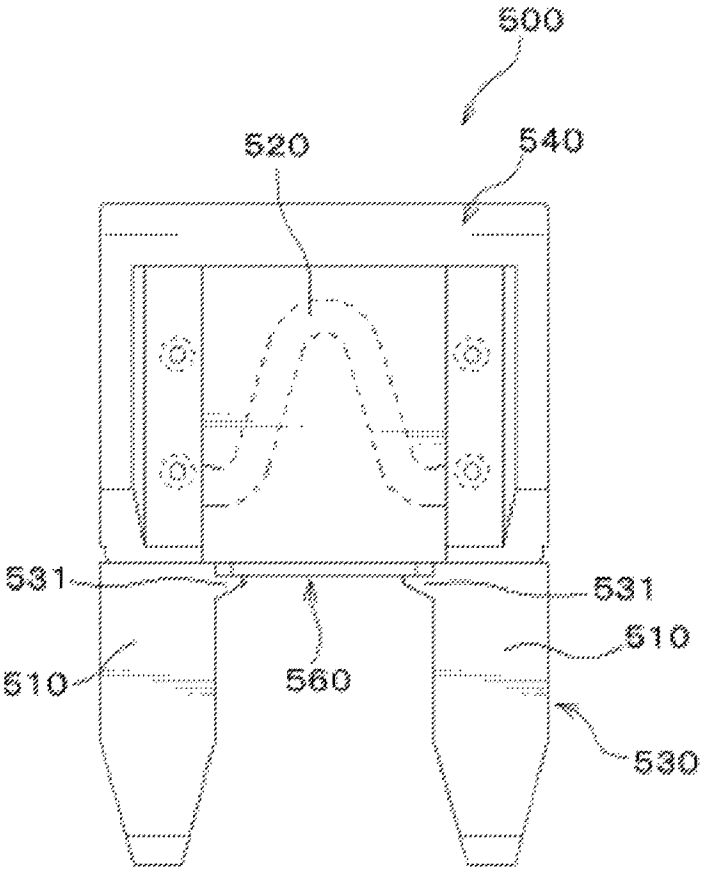
Prior Art FIG. 7A

FIG. 7(*a*) is a plan view of a conventional fuse, and FIG. 7(*b*) is a side view thereof.

DETAILED DESCRIPTION

An embodiment of the present invention will now be described below with reference to the drawings. The embodiment to be described below exemplifies shapes and materials of respective members included in a fuse and will not be limited to the exemplified shapes and materials. As depicted in FIG. 1(*a*), it is assumed in the following description that an X direction agrees with the left-right direction of the fuse, a Y direction agrees with the up-down direction of the fuse, and a Z direction agrees with the anteroposterior direction of the fuse, when an insulating housing 40 is planarly viewed.

FIGS. 1(*a*) to 1(*d*) depict the insulating housing 40 included in a fuse 100 according to the present invention. Specifically, FIG. 1(*a*) is a plan view of the insulating housing 40, FIG. 1(*b*) is a side view of the insulating housing 40, FIG. 1(*c*) is a bottom view of the insulating housing 40, and FIG. 1(*d*) is a sectional view taken along line A-A indicated in FIG. 1(*c*).

This insulating housing 40 is hollow and has a substantially rectangular parallelepiped shape with an open bottom. Specifically, the insulating housing 40 has a front wall 41, a rear wall 42, a left wall 43, and a right wall 44 covering front, rear, left, and right ends thereof, respectively. The insulating housing 40 has a top covered with an upper wall 45 and a bottom opened as an open end 50.

As depicted in FIG. 1(*c*), the open end 50 is provided, at respective ends, with open ends 51. As to be described later with reference to FIG. 3(*b*), each of the open ends 51 is closed by a conductive terminal 10 when a fuse element 30 is inserted to the insulating housing 40. In the present invention, the open end 50 thus corresponds to an opening from which a terminal of a different fuse may enter.

The front wall 41 and the rear wall 42 at the respective ends in the thickness direction of the insulating housing 40 are provided with four projections 60 in total at positions symmetric with respect to line A-A serving as a center line. As depicted in FIG. 1(*d*), these projections 60 are continuously provided from the open end 50 to the inner wall surface of the upper wall 45 at the top of the insulating housing 40. The projections 60 each have a semicircular section perpendicular to its longitudinal direction (the up-down direction).

The insulating housing 40 is integrally formed by injection molding or the like with use of an electrically insulating material such as nylon resin, polycarbonate resin, or polyether sulfone resin. Alternatively, the entire insulating housing 40 can be formed by assembling individually formed walls, for example. Its formation method can be appropriately changed from the integral formation method.

Figure 1A:
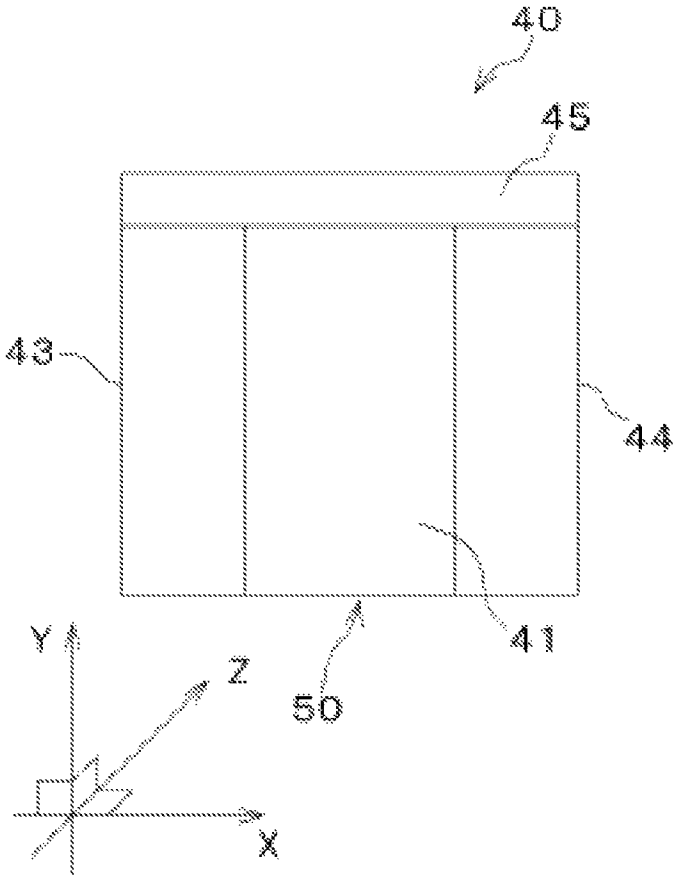
FIG. 1(*a*) is a plan view of an insulating housing of a fuse according to the present invention, FIG. 1(*b*) is a side view thereof, FIG. 1(*c*) is a bottom view thereof, and FIG. 1(*d*) is a sectional view taken along line A-A indicated in FIG. 1(*c*).
Figure 1B:
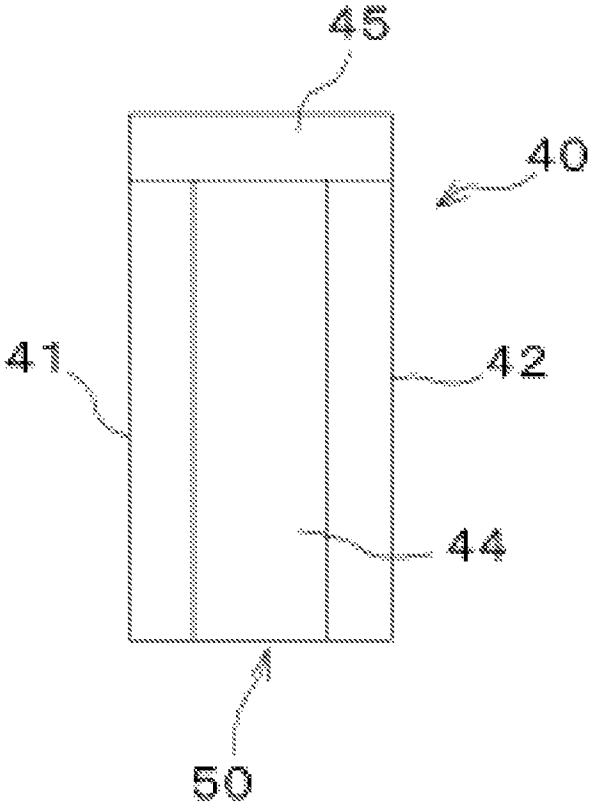
Figure 1C:
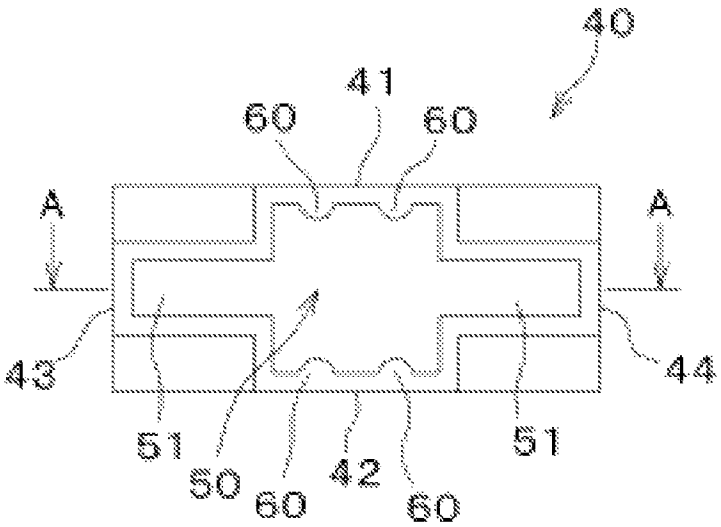
Figure 1D:
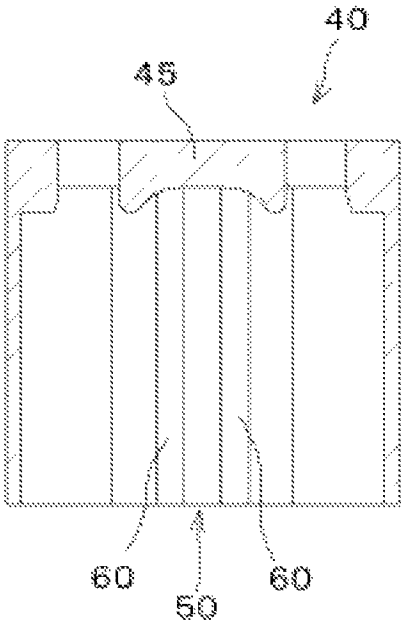
Figure 2B:
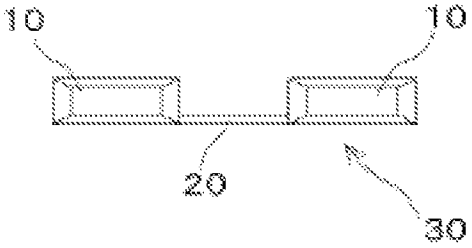
FIG. 2(*a*) is a plan view of a fuse element of the fuse according to the present invention, and FIG. 2(*b*) is a bottom view thereof.
Figure 2A:
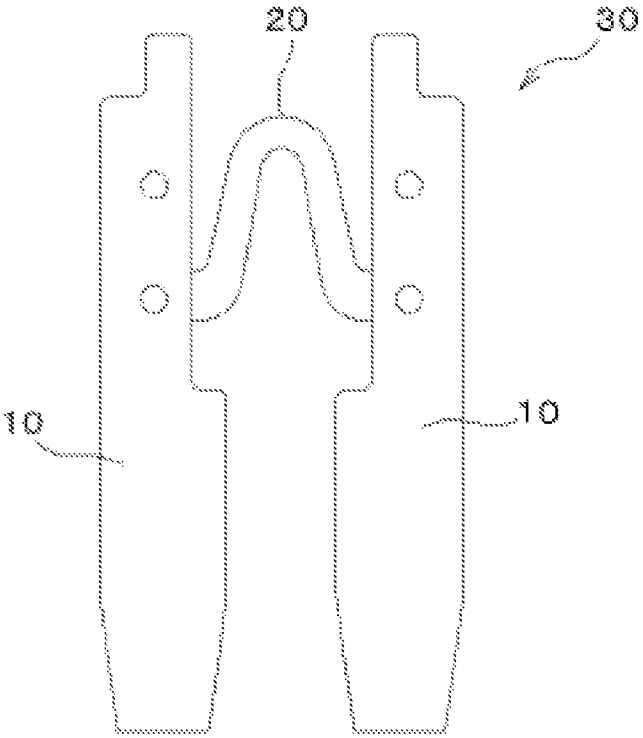
Figure 3B:
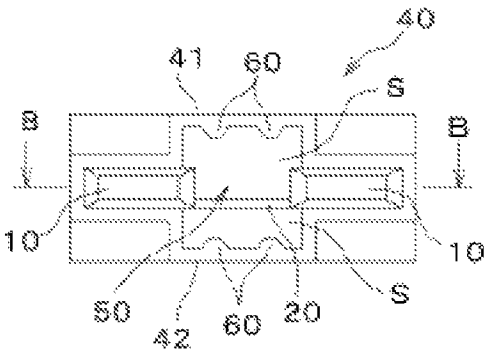
FIG. 3(*a*) is a plan view of the fuse according to the present invention, FIG. 3(*b*) is a bottom view thereof, FIG.
Figure 3A:
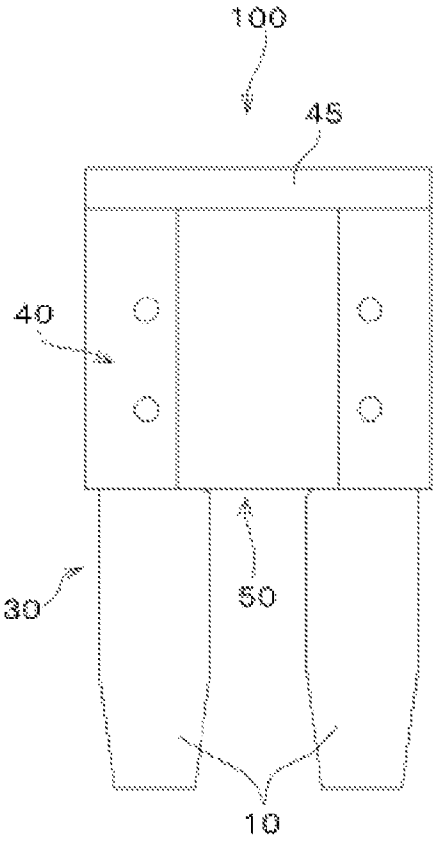
Figure 3D:
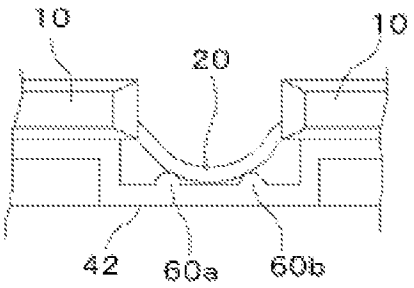
Figure 3C:
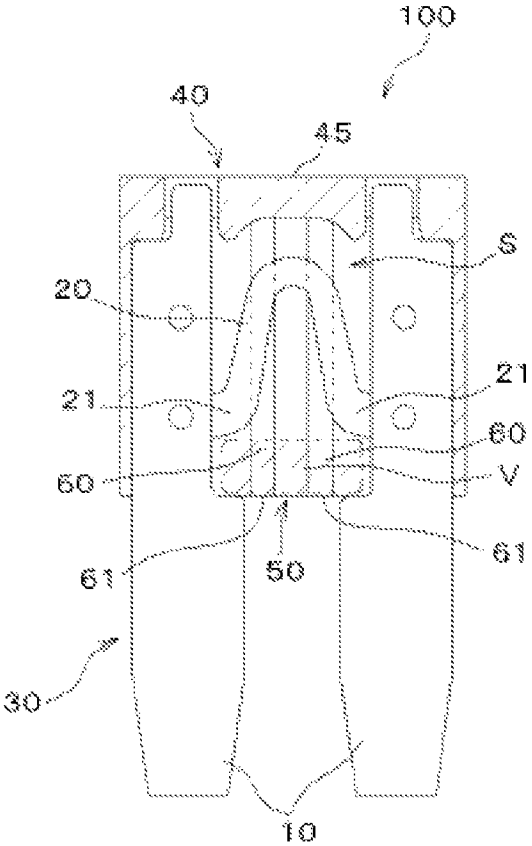
Figure 4A:
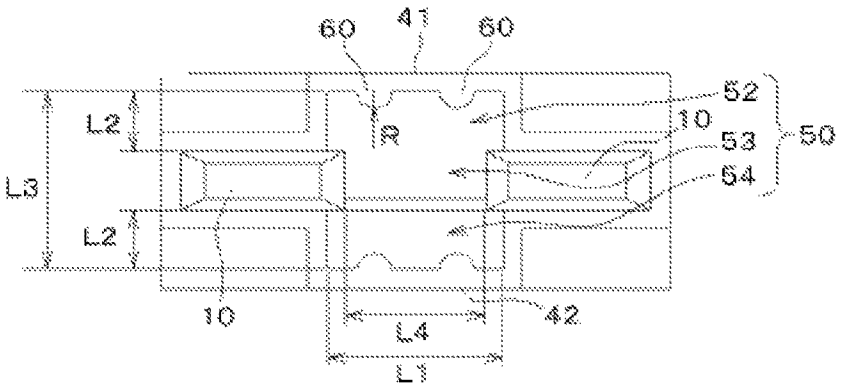
Figure 4B:
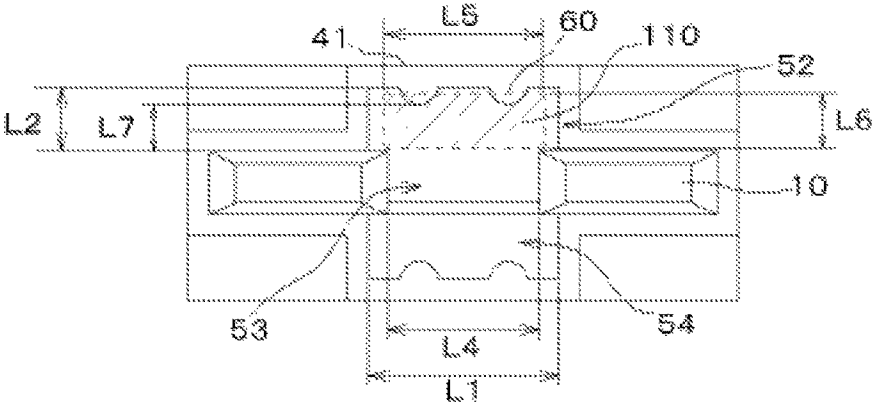
Figure 4C:
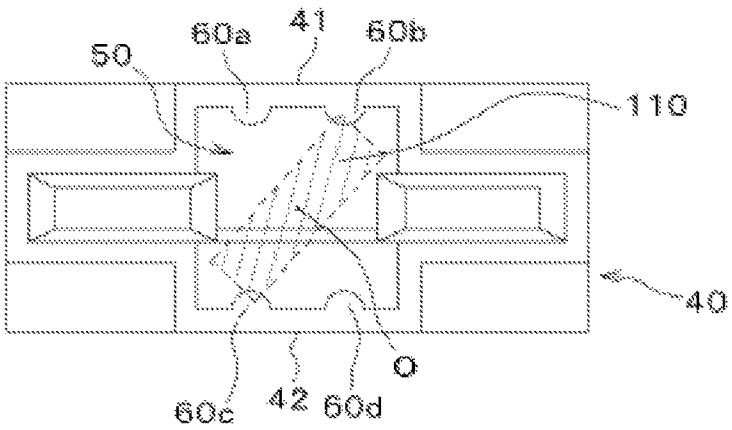
Figure 4D:
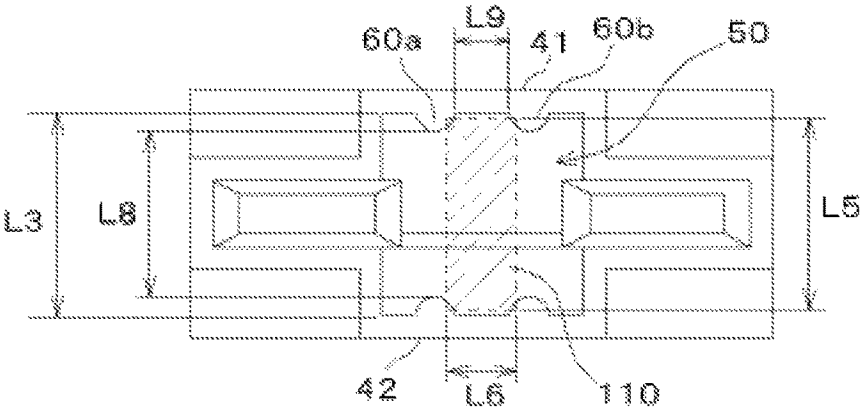

FIG. 2(*a*) is a plan view of the fuse element 30 of the fuse 100 according to the present invention, and FIG. 2(*b*) is a bottom view of the fuse element 30. The fuse element 30 includes a pair of conductive terminals 10 that is disposed in parallel with each other and has a thin plate shape, and a thin fusing part 20 that is provided between the conductive terminals 10.

The fusing part 20 has a substantially inverted U shape. The fusing part 20 is, however, not limited to such a shape but can be formed into any shape in accordance with rated current, a fusing time period, and the like. The conductive terminals 10 and the fusing part 20 can be each made of zinc, or a different material such as copper, nickel, aluminum, or silver, or alloy of any of these materials.

FIGS. 3(*a*) to 3(*c*) depict the fuse 100 obtained by attaching the fuse element 30 depicted in FIGS. 2(*a*) and 2(*b*) to the insulating housing 40 depicted in FIGS. 1(*a*) to 1(*d*). FIG. 3(*a*) is a plan view of the fuse 100, FIG. 3(*b*) is a bottom view thereof, and FIG. 3(*c*) is a sectional view taken along line B-B indicated in FIG. 3(*b*).

This fuse 100 is obtained by attaching the fuse element 30 to the insulating housing 40 such that the fuse element 30 is inserted from the open end 50 of the insulating housing 40. As depicted in FIGS. 3(*a*) to 3(*c*), the fusing part 20 is accommodated in the insulating housing 40 so as to be protected from the external environment. The conductive terminals 10 have exposed distal ends so as to contact with a fuse box and the like.

As depicted in FIG. 3(*b*), in a state where the fuse element 30 is accommodated in the insulating housing 40, the fusing part 20 has the front and rear ends surrounded with the front wall 41 and the rear wall 42, respectively, and the upper end surrounded with the upper wall 45. The open end 50 below the fusing part 20 is provided with the projections 60 so as to prevent entry of a terminal of a different fuse. The fusing part 20 is thus protected from entry of a terminal of a different fuse in every direction.

As depicted in FIG. 3(*b*), the front wall 41 and the rear wall 42 ahead of and behind the fusing part 20 are each located apart from the fusing part 20 by a predetermined distance such that a space S is secured around the fusing part 20. The fusing part 20 is designed to have fusing properties of being heated when excess current flows so as to reach its melting point and fuse in a predetermined time period. If the front wall 41 and the rear wall 42 are too close to the fusing part 20, conditions including temperature around the fusing part 20 are not optimized and the fusing part 20 cannot exert desired fusing properties. The fusing part 20, the front wall 41, and the rear wall 42 are designed to have optimum distances, and the optimum space S is secured around the fusing part 20. The number, size, and the like of the projections 60 are determined within ranges optimally securing the space S.

As depicted in FIG. 3(*c*), the projections 60 are each continuously provided to have a linear shape from the open end 50 to the inner wall surface of the upper wall 45 at the top of the insulating housing 40. As depicted in FIG. 3(*c*), part of the fusing part 20 accommodated in the insulating housing 40 crosses the projections 60 in a planar view.

As to be described in detail later, the fusing part 20 hanging downward due to a flow of excess current comes into contact with the projections 60 provided on the inner wall surface of the insulating housing 40 in such a positional relation. In comparison to a case where the hanging fusing part 20 comes into direct contact with the inner wall surface of the insulating housing 40, the fusing part 20 is likely to exert the desired fusing properties with less quantity of transferring heat.

The projections each having such a continuous linear shape with a predetermined length achieve the effect that the fusing part 20 hanging into any shape is likely to exert the desired fusing properties. The fusing part 20 is provided between the pair of conductive terminals 10. The fusing part 20 may have a shape other than the substantially inverted U shape as depicted in FIG. 3(*c*). Even in such a case, the projections 60 are located between the pair of conductive terminals 10 and each have the linear shape with a predetermined length. The projections 60 thus always cross the fusing part 20 in a planar view. Regardless of its shape, the hanging fusing part 20 highly possibly comes into contact with the projections 60 and is likely to exert the desired fusing properties.

The projections 60 are provided continuously from the inner wall surface of the open end 50 to the inner wall surface of the upper wall 45 of the insulating housing 40. This configuration is, however, not essential to prevention of entry of a terminal of a different fuse from the open end 50.

If only the projections 60 are provided on the inner wall surface of the open end 50 of the insulating housing 40, a terminal of a different fuse, which tends to enter from the open end 50, will come into contact with the projections 60. Each of the projections 60 may not be provided continuously to have a long shape, but can alternatively be provided partially to have a short shape with an appropriate length only at the open end 50 of the insulating housing 40, for example.

As depicted in FIG. 3(*c*), the projections 60 each have an end 61 that is located to extend along an end surface of the open end 50. The present invention is not necessarily limited to such s location, but the end 61 can be located behind the end surface of the open end 50 toward the upper wall 45. A terminal of a different fuse, which tends to enter from the open end 50, has only to be prevented from contacting with the fusing part 20. Accordingly, the end 61 has only to be located within the range (see a range V indicated by oblique lines in FIG. 3(*c*)) from the position along the end surface of the open end 50 (the state depicted in FIG. 3(*c*)) to a position below a lower end 21 of the fusing part 20.

The state where the projections according to the present invention are "provided on the inner wall surface of the open end of the insulating housing" includes the state where the end 61 of each of the projections 60 provided on the inner wall surface of the insulating housing 40 is located within the range from the position in contact with the open end 50 to the position below the lower end 21 of the fusing part 20, that is, the range V indicated in FIG. 3(*c*).

Described next with reference to FIG. 3(*d*) is the case where the fusing part 20 hangs downward.

As depicted in FIG. 3(*d*), when the fusing part 20 melts due to a flow of excess current and hangs downward, the hanging portion comes into contact with surfaces of the projections 60. The fusing part 20 is thus prevented from hanging further downward and coming into contact with the inner wall surface of the rear wall 42. If the projections 60 are not provided, the hanging fusing part 20 comes into surface contact with a large range on the flat inner wall surface of the rear wall 42, and a large amount of heat transfers from the contact portion. The hanging fusing part 20 contacts with the projections 60 by a contact area smaller than that of a case where the fusing part 20 is in surface contact with the flat inner wall surface of the rear wall 42 in a large range. The fusing part 20 is thus likely to exert the desired fusing properties with less quantity of transferring heat.

The number of the provided projections 60 is not limited, but in particular, at least two projections are preferably located apart from each other on a single inner wall surface. In the fusing part 20, the both ends are fixed to the conductive terminals 10, respectively whereas the center is floating. When the fusing part 20 melts due to a flow of excess current, the center hangs downward due to gravity. As depicted in FIG. 3(*d*), the fusing part 20 is supported on both sides at two positions slightly apart from the center of the fusing part 20 by the two projections 60 (namely, a projection 60*a* and a projection 60*b*). The fusing part 20 can thus be more reliably prevented from hanging further downward and coming into contact with the inner wall surface of the rear wall 42.

Depending on the shape of the fusing part 20 and the posture of the fuse 100, the center of the fusing part 20 may not hang simply downward as depicted in FIG. 3(*d*) but can hang downward at a position displaced leftward or rightward therefrom. In the case where at least two projections 60 are located apart from each other, the hanging portion of the fusing part 20 comes into contact with either one of the projections 60 (the projection 60*a* or 60*b*) and can be prevented from contacting with the inner wall surface of the rear wall 42.

There is provided an enough gap between the fusing part 20 and the inner wall surface of the insulating housing 40 (the inner wall surface of each of the front wall 41 and the rear wall 42). The hanging fusing part 20 will not always come into contact with the inner wall surface of the insulating housing 40. The fusing part 20 can possibly hang downward beyond estimation due to the state of use of the fuse 100 and the like. The projections 60 are expected to exert the effect mentioned above in such a case.

Preventing a terminal of a different fuse from entering the insulating housing will be described in detail next with reference to FIGS. 4(*a*) to 4(*d*).

A large number of fuses 100 are packed together for storage or delivery. A terminal of a different fuse may occasionally enter the open end 50 of the insulating housing 40 of one of the fuses 100. The terminal of the different fuse having entered may damage the fusing part 20. Preventing a terminal of a different fuse from entering the open end 50 at any angle (vertically, laterally, or obliquely) by means of the projections 60 will now be described in each of cases depicted in FIGS. 4(*b*) to 4(*d*).

The open end 50 of the fuse 100 will be initially described in detail in terms of its configuration with reference to FIG. 4(*a*).

As depicted in FIG. 4(*a*), inner portions of the pair of conductive terminals 10 overhang toward the center of the open end 50. For convenience sake, a portion of the open end 50 ahead of the conductive terminals 10 will be referred to as a front open end 52, a center portion of the open end 50 between the conductive terminals 10 will be referred to as a center open end 53, and a portion of the open end 50 behind the conductive terminals 10 will be referred to as a rear open end 54.

Assume that the front open end 52 and the rear open end 54 have a lateral width L1, and the front open end 52 and the rear open end 54 have a vertical width L2 (the distance between the inner surface of the front wall 41 and the front surfaces of the conductive terminals 10, and the distance between the rear surfaces of the conductive terminals 10 and the inner surface of the rear wall 42, respectively). The front open end 52 and the rear open end 54 are shaped identically with each other. Furthermore, assume that the open end 50 has a vertical width (the distance from the inner surface of the front wall 41 to the inner surface of the rear wall 42) L3 and the pair of conductive terminals 10 has a distance L4 therebetween at the center open end 53. Also assume that the projections 60 provided on the inner surface of the front wall 41 and the inner surface of the rear wall 42 each have a radius R.

Assume that the different fuse indicated by oblique lines in FIGS. 4(*b*) to 4(*d*) includes a conductive terminal 110 that has a lateral width (a longer width) L5 and a vertical width (a shorter width) L6. Fuses of one type are often packed. In this case, the lateral width L5 and the vertical width L6 of the different conductive terminals 110 are equal to the lateral width and the vertical width of the conductive terminals 10 of the fuse 100.

Described with reference to FIG. 4(*b*) is a case where the different conductive terminal 110, which is provided laterally, tends to enter the front open end 52. The following description also applies to the rear open end 54 that is shaped identically with the front open end 52.

In a case where the lateral width L1 of the front open end 52 is set to be not less than the lateral width L5 of the different conductive terminal 110 and the vertical width L2 of the front open end 52 is set to be not less than the vertical width L6 of the different conductive terminal 110, the different conductive terminal 110 being provided laterally tends to enter the front open end 52 as depicted in FIG. 4(*b*). The projections 60 are, however, provided on the inner wall surface of the front wall 41. The different conductive terminal 110 thus comes into contact with the projections 60 and cannot enter the front open end 52.

As depicted in FIG. 4(*b*), in order to more reliably prevent the different conductive terminal 110 being provided laterally from entering the front open end 52, a distance L7=(L2−R) from an apex of the projection 60 to an end surface of the conductive terminal 10 is made smaller than the vertical width L6 of the different conductive terminal 110. When the projection 60 does not have the semicircular shape, the radius R is replaced with the distance from the inner wall surface of the insulating housing 40 to the apex of the projection 60.

Obviously, in a case where the lateral width L1 of the front open end 52 is set to be less than the lateral width L5 of the different conductive terminal 110 or the vertical width L2 of the front open end 52 is set to be less than the vertical width L6 of the different conductive terminal 110, the different conductive terminal 110 being provided laterally will not enter the front open end 52.

The lateral width L4 between the conductive terminals 10 is smaller than the lateral width L5 of the different conductive terminal 110. Accordingly, the different conductive terminal 110 being provided laterally will not enter from the center open end 53.

Described next with reference to FIG. 4(*c*) is a case where the different conductive terminal 110, which is provided obliquely, tends to enter the open end 50.

As depicted in FIG. 4(*c*), the open end 50 having a substantially rectangular shape has the largest width on its diagonal line. The different conductive terminal 110, which is provided substantially along the diagonal line or is provided obliquely, occasionally tends to enter the open end 50.

As depicted in FIG. 4(*c*), the projections 60 are provided respectively on the inner wall surfaces in the thickness direction of the insulating housing 40. The different conductive terminal 110 thus comes into contact with the projection 60 provided on the inner wall surface of the front wall 41 or the projection 60 provided on the inner wall surface of the rear wall 42. Entry of the different conductive terminal 110 can thus be prevented more reliably.

Alternatively, at least two projections 60 can be located apart from each other on an identical inner wall surface. As exemplarily depicted in FIG. 4(*c*), the two projections 60*a* and 60*b* are located apart from each other on the inner wall surface of the front wall 41. Even in a case where the different conductive terminal 110, which is provided obliquely right upward as depicted in FIG. 4(*c*) or is provided obliquely left upward, tends to enter, the different conductive terminal 110 comes into contact with the projection 60*a* and cannot enter the open end 50.

Provision of at least two projections 60 located apart from each other on an identical inner wall surface can thus more reliably prevent entry of the different conductive terminal 110 that tends to enter the open end 50 at any oblique angle, e.g. obliquely right upward or obliquely left upward.

The projections 60 can be located variously in order to prevent the different conductive terminal 110 being provided obliquely from entering the open end 50. For example, the projections 60 can be located in the following manner.

For example, in a case where the different conductive terminal 110 tends to enter with its center displaced from a center O of the open end 50, part of the different conductive terminal 110 comes into contact with one of peripheral end surfaces of the open end 50 and is prevented from entering. In a case where the different conductive terminal 110 tends to enter with the center substantially overlapped with the center O of the open end 50 as depicted in FIG. 4(*c*), the different conductive terminal 110 may possibly enter the open end 50 without contacting with any one of the peripheral end surfaces of the open end 50.

In view of this, the projection 60*b* and a projection 60*c* are located at positions symmetric with respect to the center O of the open end 50 (in other words, the middle point of the diagonal line of the open end 50) as depicted in FIG. 4(*c*). Even if the different conductive terminal 110 tends to enter with the center overlapped with the center O of the open end 50, the both ends of the different conductive terminal 110 come into contact with the projections 60*b* and 60*c*, respectively. Oblique entry of the different conductive terminal 110 can thus be prevented more reliably.

Described next with reference to FIG. 4(*d*) is a case where the different conductive terminal 110, which is provided vertically, tends to enter the open end 50.

In a case where the vertical width L3 of the open end 50 is set to be not less than the lateral width (the longer width) L5 of the different conductive terminal 110, the different conductive terminal 110 being provided vertically tends to enter the open end 50 as depicted in FIG. 4(*d*). The projections 60 are provided respectively on the inner wall surfaces in the thickness direction (the inner wall surfaces of the front wall 41 and the rear wall 42) as depicted in FIG. 4(*d*). The different conductive terminal 110 thus comes into contact with the projection 60 provided on the inner wall surface of the front wall 41 or the projection 60 provided on the inner wall surface of the rear wall 42. Entry of the different conductive terminal 110 can thus be prevented more reliably.

Alternatively, at least two projections 60 can be located apart from each other on an identical inner wall surface. As exemplarily depicted in FIG. 4(*d*), the two projections 60*a* and 60*b* are located apart from each other on the front wall 41. Even in cases where the different conductive terminal 110 tends to enter the open end 50 at the center position as depicted in FIG. 4(*d*) as well as where the different conductive terminal 110 tends to enter at a position displaced leftward or rightward from the center, the different conductive terminal 110 comes into contact with the projection 60*a* or 60*b* and cannot enter the open end 50.

Provision of at least two projections 60 located apart from each other on an identical inner wall surface can thus more reliably prevent entry of the different conductive terminal 110 that is provided vertically and tends to enter the open end 50 at any position displaced leftward or rightward.

The projections 60 can be located variously in order to prevent the different conductive terminal 110 being provided vertically from entering the open end 50. For example, the projections 60 can be located in the following manner.

In a case where, for example, a distance L8 between the apexes of the projections 60 opposite to each other in the thickness direction is set to be less than the lateral width (the longer width) L5 of the different conductive terminal 110, the both ends of the different conductive terminal 110, which is provided vertically and tends to enter, come into contact with the opposite projections 60, respectively. Vertical entry of the different conductive terminal 110 can thus be prevented more reliably.

In a case where a distance L9 between the ends of the projections 60 adjacent to each other is set to be less than the vertical width (the shorter width) L6 of the different conductive terminal 110, the different conductive terminal 110 being provided vertically can be easily prevented from entering the open end 50 through the gap between the adjacent projections 60.

Obviously, in a case where the vertical width L3 of the open end 50 is set to be less than the lateral width L5 of the different conductive terminal 110, the different conductive terminal 110 being provided vertically will not enter the open end 50.

As described above, FIGS. 4(*b*) to 4(*d*) depict representatively estimated cases where the different conductive terminal 110 tends to enter the open end 50. Most appropriate details of the projections 60, such as locations and sizes, have been described in the respective cases according to examples. The conditions such as the locations and the sizes of the projections 60 according to these examples are merely exemplary in the respective cases for more easily preventing the different conductive terminal 110 from entering the open end 50. It is obvious that provision of the projections 60 on the inner wall surfaces of the open end 50 of the insulating housing 40 effectively prevents the different conductive terminal 110 from entering the open end 50 even in a case where conditions are not limited to those according to these examples.

(Modification Examples 1 and 2)

A fuse 200 according to the modification example 1 and a fuse 300 according to the modification example 2 of the fuse 100 of the present invention will now be described below with reference to FIGS. 5(*a*) and 5(*b*). The fuse 200 and the fuse 300 include projections 260 and projections 360, respectively, which are different in shape from the projections 60 in the fuse 100, but are in common with the fuse 100 in the remaining configurations. Such common configurations will not be described repeatedly.

As depicted in FIG. 5(*a*), the projections 260 in the fuse 200 each have a triangular shape. The different conductive terminal 110, which is provided vertically, laterally, or obliquely (see FIGS. 4(*b*) to 4(*d*)) and tends to enter the open end 250, comes into contact with one of the projections 260. The different conductive terminal 110 cannot enter an insulating housing 240 from an open end 250 and a fusing part 220 will not be damaged.

As depicted in FIG. 5(*b*), the projections 360 in the fuse 300 each have a trapezoidal shape. The different conductive terminal 110, which is provided vertically, laterally, or obliquely (see FIGS. 4(*b*) to 4(*d*)) and tends to enter an open end 350, comes into contact with one of the projections 360 and cannot enter an insulating housing 340.

As in the modification examples described above, the projections can be appropriately modified in terms of their shapes. The projections provided at the open end can prevent a terminal of a different fuse from entering the housing.

(Modification Example 3)

A fuse 400 according to the modification example 3 of the fuse 100 of the present invention will now be described below with reference to FIGS. 6(*a*) to 6(*d*). The fuse 400 includes projections 460 that are different in shape from the projections 60 in the fuse 100, but are in common with the fuse 100 in the remaining configurations. Such common configurations will not be described repeatedly.

As depicted in FIGS. 6(*a*) to 6(*c*), the projections 460 are each shaped differently from each other at an open end 450 and at an upper end. Specifically, as depicted in FIG. 6(*a*), lower projections 461 each having a semicircular shape are provided continuously from the open end 450 to below a lower end 421 of a fusing part 420, and upper projections 462 each having a triangular shape are provided continuously from the lower end 421 to the upper end, in other words, in the range crossing the fusing part 420.

As depicted in FIG. 4(*b*), the four projections 460 in total are provided on a front wall 441 and a rear wall 442 at the both ends in the thickness direction of an insulating housing 440.

FIG. 4(*c*) is an enlarged bottom view of the projection 460. As apparent from this figure, the upper projection 462 in the triangular shape protrudes from the lower projection 461. The upper projection 462 located at the position crossing the fusing part 420 is formed to have the triangular shape in order that the fusing part 420 is more likely to exert the desired fusing properties.

Specifically, as depicted in FIG. 4(*d*), the fusing part 420 hanging downward due to a flow of excess current comes into point contact with apexes of the upper projections 462 in the triangular shape. Such point contact minimizes contact areas, so as to reduce the amount of heat transferring through the contact portion. In this case, the fusing part 420 is more likely to exert the desired fusing properties.

The fuse according to the present invention is not limited to the examples described above, but can be embodied in accordance with various modification examples and combinations within the scope recited in claims and the scope of the embodiment. These modification examples and combinations are to be included in the scope of rights of the present invention.

INDUSTRIAL APPLICABILITY

The fuse according to the present invention is not only applied to an electric circuit of a motor vehicle, but also can be applied to an electric circuit for any purpose. Such applications are obviously included in the scope of the present invention.

The invention claimed is:

1. A fuse comprising:

a pair of conductive terminals;

a fuse element including a fusing part provided between the conductive terminals; and an insulating housing covering the fusing part and at least part of the conductive terminals and having an open bottom end but omitting a flap configured to open and close to prevent entry of another conductive terminal into the bottom end of the insulating housing;

the fuse having an opening between the pair of conductive terminals, with the pair of conductive terminals being incorporated in the insulating housing, wherein:

the insulating housing having a plurality of projections on an inner wall surface of the insulating housing to prevent entry of another conductive terminal within the housing;

only two projections are provided on the inner wall surface at each side in a thickness direction of the insulating housing, and a distance between apexes of the projections located on opposing sides of the inner wall surface is set to be less than a lateral width of a distal end of the conductive terminal and a distance between the two projections provided on a same side of the inner wall surface is set to be less than a thickness of a distal end of the conductive terminal to prevent entry of another conductive terminal, such that another conductive terminal of an identical fuse cannot be inserted within the housing.

2. The fuse according to claim 1, wherein the at least one projection is provided from the open bottom end extending towards an upper end of the inner wall surface of the insulating housing.

3. The fuse according to claim 1, wherein the at least one projection has a predetermined shape adapted to prevent entry of said another conductive terminal into the insulating housing.

4. The fuse according to claim 1, wherein the insulating housing comprises two spaced apart opposing inner walls that extend parallel relative to each other, wherein each inner wall has the only two projection provided thereon that extends towards an interior of the insulating housing with a predetermined shape adapted to prevent entry of said another conductive terminal into the insulating housing.

5. The fuse according to claim 4, wherein each projection has a same predetermined shape and is coplanar relative to another projection in a longitudinal direction of the fuse.

6. The fuse according to claim 4, wherein each projection continuously extends along the inner wall throughout an entire interior length of the insulating housing.

7. The fuse according to claim 4, wherein each projection discontinuously extends along the inner wall of the insulating housing.

8. The fuse according to claim 5, wherein each projection has semi-circular or triangular shape.

* * * * *